US006364448B2

(12) United States Patent
Nishioka et al.

(10) Patent No.: US 6,364,448 B2
(45) **Date of Patent: *Apr. 2, 2002**

(54) INK JET PRINTER AND INK PRIMING METHOD THEREFOR

(75) Inventors: Atsushi Nishioka, Shiojiri; Yukihiro Hanaoka, Nagano-ken; Satoshi Yoda, Okaya, all of (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/352,282

(22) Filed: Jul. 13, 1999

(30) Foreign Application Priority Data

Jul. 15, 1998 (JP) ..... 10-201011

(51) Int. Cl.[7] ..... B41J 2/165
(52) U.S. Cl. ..... 347/23; 347/92; 347/29
(58) Field of Search ..... 347/23, 92, 29, 347/35

(56) References Cited

U.S. PATENT DOCUMENTS

| | | | | |
|---|---|---|---|---|
| 4,668,965 A | | 5/1987 | Tanaka et al. | 347/26 |
| 5,248,999 A | * | 9/1993 | Mochizuki et al. | 347/23 |
| 5,946,015 A | * | 8/1999 | Courtney | 347/92 |
| 5,949,447 A | * | 9/1999 | Arai et al. | 347/23 |
| 6,050,668 A | * | 4/2000 | Ikado | 347/23 |

FOREIGN PATENT DOCUMENTS

| | | | |
|---|---|---|---|
| EP | 0 427 202 | | 5/1991 |
| EP | 0 615 846 | A1 * | 9/1994 |
| EP | 0 694 404 | A2 * | 1/1996 |
| EP | 0 803 359 | | 10/1997 |
| JP | 2-303848 | | 12/1990 |
| JP | 5-269998 | | 10/1993 |
| JP | 6-106732 | | 4/1994 |
| JP | 8-267785 | | 10/1996 |
| JP | 2653043 | | 5/1997 |
| JP | 10-138474 | | 5/1998 |

* cited by examiner

*Primary Examiner*—N. Le
*Assistant Examiner*—Shih-wen Hsieh
(74) *Attorney, Agent, or Firm*—Mark P. Watson

(57) ABSTRACT

An ink jet printer reliably prevents printing defects resulting from bubbles remaining in the ink path after ink priming. An ink suction mechanism of the ink jet printer performs a post-priming head recovery process for suctioning ink from the nozzles when an hour passes after the ink priming process. This process suctions a large volume of ink from the ink nozzles, and can thus reliably expel bubbles from the ink path. By performing this process at a sufficiently long specific period of time after ink priming, enough time has elapsed for bubbles that are formed by the ink path filter during ink priming and collect in offsets in the ink path to grow to a size where the bubbles protrude from the offset into the ink path. Bubbles that are thus freed into the ink path can therefore be reliably expelled from the nozzles. Printing defects resulting from bubbles left by ink priming can thus be reliably prevented.

32 Claims, 13 Drawing Sheets

[ Ink suction process selected based on elapsed time (A,S) ]

INK JET PRINTER AND INK PRIMING METHOD THEREFOR

BACKGROUND OF THE INVENTION

1. Field of the Invention

The present invention relates to an ink jet printer, and relates more particularly to an ink priming method therefor, and to an ink jet head recovery process applied after ink priming.

2. Description of the Related Art

Once a user purchases an ink jet printer and installs an ink cartridge into the printer in order to use it, an ink priming operation is required to charge the ink path from the cartridge to the nozzles with ink from the ink cartridge. Methods accomplishing this with an ink suction mechanism have been proposed. Japanese Unexamined Patent Application Publication (kokai) 8-267785, for example, teaches an ink jet printer comprising such an ink suction mechanism.

Immediately after priming the nozzles of the print head by filling the ink path with ink from the ink cartridge, a large number of air bubbles is left in the ink path due to the ink passing a filter disposed in the ink path. The bubbles also tend to accumulate where there is an offset in the walls of the ink path, such as that part of the ink path where the ink supply tube connects to the head. While the bubbles are sufficiently small, the bubbles become trapped in the corners of these offsets and are thus not in the path of ink flow produced by suction in the ink recovery process. These small bubbles thus do not reach the nozzles, and therefore do not cause nozzle failure, that is, ink ejection problems.

Small bubbles that are trapped in these offsets gradually grow as a result of, for example, a rise in ink temperature after the printer power is turned on, and an increase in surface tension resulting from aggregation of numerous small bubbles. Eventually the bubbles grow to a size at which the bubble B protrudes from the offset and is affected by the flow of ink through the ink path. As shown FIG. 12, the bubble B may block the ink path. A bubble large enough to protrude from the ink path offset into the ink path can then be pulled into an ink chamber in the print head at the flow rate produced by a normal suction type ink head recovery process, but will not be expelled from the nozzle.

Small bubbles trapped at such offsets in the ink path immediately after the ink priming operation also cannot be expelled from the nozzles no matter how much the ink flow rate is increased for the head suction recovery process.

Bubbles that become attached to an inside wall of the ink path during the ink priming operation and there remain are also gradually freed from the wall into the ink path as surface tension increases and the wetness of the inside walls increase over time. As a result, these bubbles are carried toward the ink head and are left in the ink nozzle(s) by the ink suction operation used for regular head recovery. When the head is then driven for printing, bubbles in the nozzles cause such printing problems as non-firing nozzles.

The size of small bubbles formed by ink priming also gradually increases as a result of an increase in printer temperature when the ink jet printer power is left on. Temperature rises approximately 10 degrees in the first hour after ink jet printer power is turned on, and continues to gradually rise thereafter. Some conventional ink jet printers therefore run the head recovery suction process immediately following ink priming in an attempt to remove these small bubbles, but this results in wasted ink consumption.

When the bubble size grows to a point at which it affects ink flow after ink priming, some conventional ink jet printers apply a normal nozzle recovery suction process using a small amount of ink. With this method, however, bubbles are conversely transported into the print head pressure chamber. As a result, driving the diaphragm to pressurize the chamber simply compresses the large bubble (Pascal's law); pressure is therefore not transmitted to the ink, and ink cannot be ejected from the nozzles.

OBJECTS OF THE INVENTION

Therefore, it is an object of the present invention to overcome the aforementioned problems.

With consideration for the above problems, an object of the present invention is to provide an ink jet printer and an ink head recovery process therefor wherein ink waste accompanying an ink suction head recovery process can be reliably avoided, and ink ejection defects accompanying a nozzle recovery suction process as a result of bubbles left in the ink path during ink priming can be reliably avoided.

SUMMARY OF THE INVENTION

To achieve these and other objects, an ink jet printer according to the present invention comprises a print head having ink nozzles for ejecting ink droplets; an ink tank for storing ink; an ink path for supplying ink from the ink tank to the print head; and an ink suction unit having at least an ink pump and a nozzle capping member for suctioning ink from the ink nozzle. The ink suction unit also performs a post-priming head recovery process for further suctioning ink after ink is first filled from the ink tank to the print head by way of the ink path.

A further ink jet printer according to the present invention has an ink tank for storing ink; an ink jet head for expelling ink from a nozzle for printing a character on a printing medium; an ink path to which ink is supplied from the ink tank for supply to the ink jet head; and an ink suction unit for suctioning ink from the ink nozzle by way of a nozzle cap for initially filling the ink path from the ink tank to the nozzle. The ink suction unit suctions a specific amount of ink from the nozzle after a bubble left in the ink path during ink priming grows to a particular size.

The ink suction unit preferably comprises at least a nozzle cap for covering the nozzles, and an ink suction pump connected to the nozzle cap.

An ink priming method for the print head of an ink jet printer according to the present invention comprises: an ink priming step for first charging ink to an ink path for supplying ink to an ink nozzle of the print head; a step for determining whether a specific time period has elapsed since the ink priming step; a step for performing a post-priming head recovery process wherein ink is suctioned and expelled from an ink nozzle when the specific time period has elapsed.

An ink jet printer and ink priming method according to the present invention can thus reliably expel from the ink nozzles small bubbles that are formed during the ink priming process and later grow to bubbles of a certain larger size.

The post-priming head recovery process is preferably performed after a specific time period elapses following ink priming. When this post-priming head recovery process is performed after waiting a specific period of time, bubbles that are formed during ink priming, accumulate in offsets in the ink path where the ink path diameter changes, have grown to a certain size, and are free in the ink flow can be reliably expelled from the ink nozzles. As a result, waste from ink suction accompanying a head recovery process can be prevented.

The post-priming head recovery process also suctions a larger volume of ink than does a normal head recovery process. Bubbles that remain in the ink path after ink priming can thus be reliably expelled from the ink nozzles and prevented from stopping in the pressure chamber. Printing defects attributable to a head recovery process can therefore be avoided.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

FIG. 9 is a flow chart of the ink suction process shown in FIG. 6 performed immediately after the printer power is turned on;

DESCRIPTION OF THE PREFERRED EMBODIMENTS

An ink jet printer according to the present invention is described next below with reference to the accompanying drawings.

Figure 2:
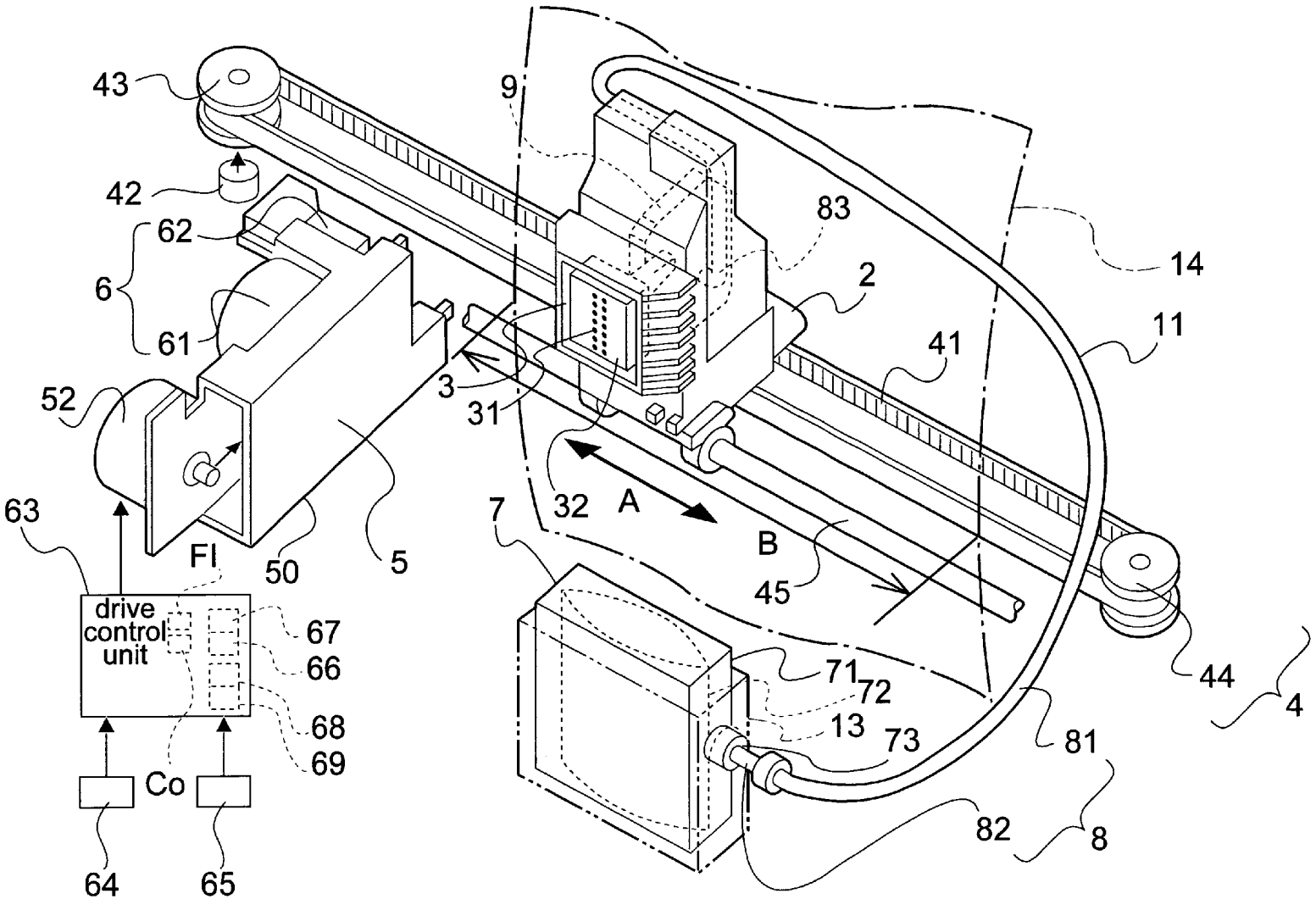
FIG. 2 is a further perspective view showing major components of the ink jet printer shown in FIG. 1.
Figure 10:
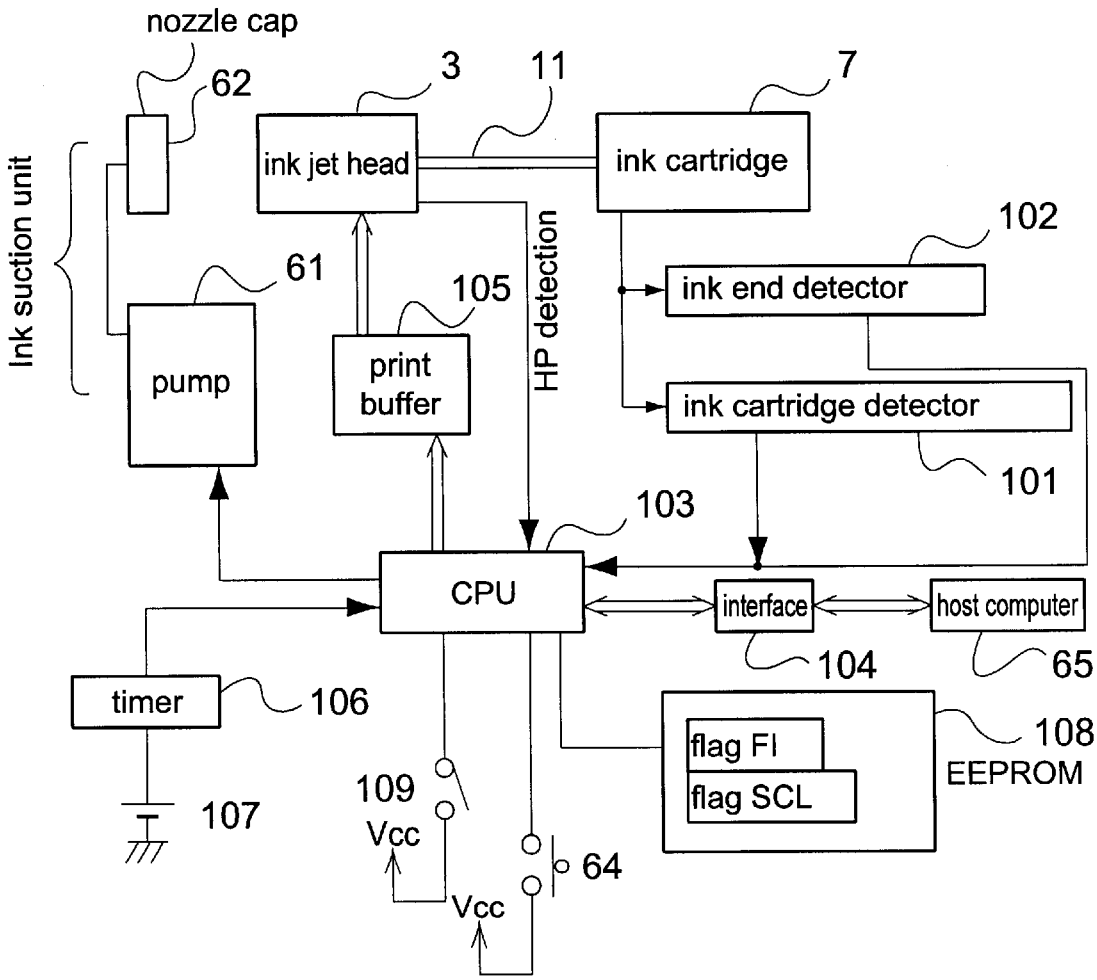
FIG. 10 is a block diagram of the present invention.

FIG. 10 is a schematic block diagram of the major functional units of an ink jet printer according to the present invention, while FIG. 2 is a perspective view showing the major components.

Referring to FIGS. 2 and 10, an ink tank 72 is housed in the ink cartridge 7. An ink cartridge detector 101 detects whether or not an ink cartridge 7 is installed in the ink jet printer. An ink end detector 102 detects whether any ink is left in the ink tank 72.

Ink is filled from the ink tank 72 by way of ink path 11 to the nozzles 31 in ink jet print head 3. A nozzle cap 62 and pump 61 enable ink to be suctioned from the nozzles 31 in an ink suction process. A CPU 103 for controlling the ink jet printer controls pump 61, and receives signals output from the ink cartridge detector 101 and ink end detector 102.

When the ink cartridge detector 101 is unable to detect that the ink cartridge 7 is installed to the ink jet printer, such as when the ink cartridge 7 is not installed, it issues an "ink cartridge not installed" warming signal. When the ink end detector 102 determines that there is no ink, such as when there is substantially no ink in the ink tank 72 of the ink cartridge 7, the ink end detector 102 issues an "ink end" warning signal. Various methods can be used for issuing these two warning signals as outwardly detectable events, including, for example, turning on an LED or flashing an LED, or sounding an audible alarm.

When the CPU 103 receives print data from a host computer 65 through an interface (I/F) 104, it drives the print head 3 using a print buffer 105 to print the received data. A timer 106 is preferably backed up by a backup battery 107 to enable counting to continue even when printer power is turned off. An EEPROM 108 stores an ink priming completion flag FI, and a post-priming recovery process completion flag SCL. The CPU 103 can determine whether either one or both of the ink priming completion flag FI and post-priming recovery process completion flag SCL is set.

When the CPU 103 detects that the manual cleaning switch 64 is on, it performs a normal cleaning process by controlling the number of steps a step motor for driving pump 61 turns to control the amount of ink suctioned by the pump 61. Alternatively to controlling the number of steps the step motor for pump 61 is driven, the CPU 103 can control ink suction based on the pump 61 drive time counted by the timer 106. Although timer 106 is shown as one functional block in FIG. 10, it may actually comprise a variety of components including a real-time-clock, counters, registers, etc., as is well known in the art.

A power switch 109 for controlling the on/off state of the power supply to the overall ink jet printer is also provided. As noted above, the timer 106 can be backed up by a backup battery 107 when this power switch 109 is turned off so that the timer 106 can continue tracking time.

The CPU 103 also controls the location of the print head 3 on the carriage. It can thus detect whether the print head 3 is positioned at the nozzle cap 62, and if the print head 3 is not positioned next to the nozzle cap 62, CPU 103 can move the print head 3 to the opposing position.

Figure 13:
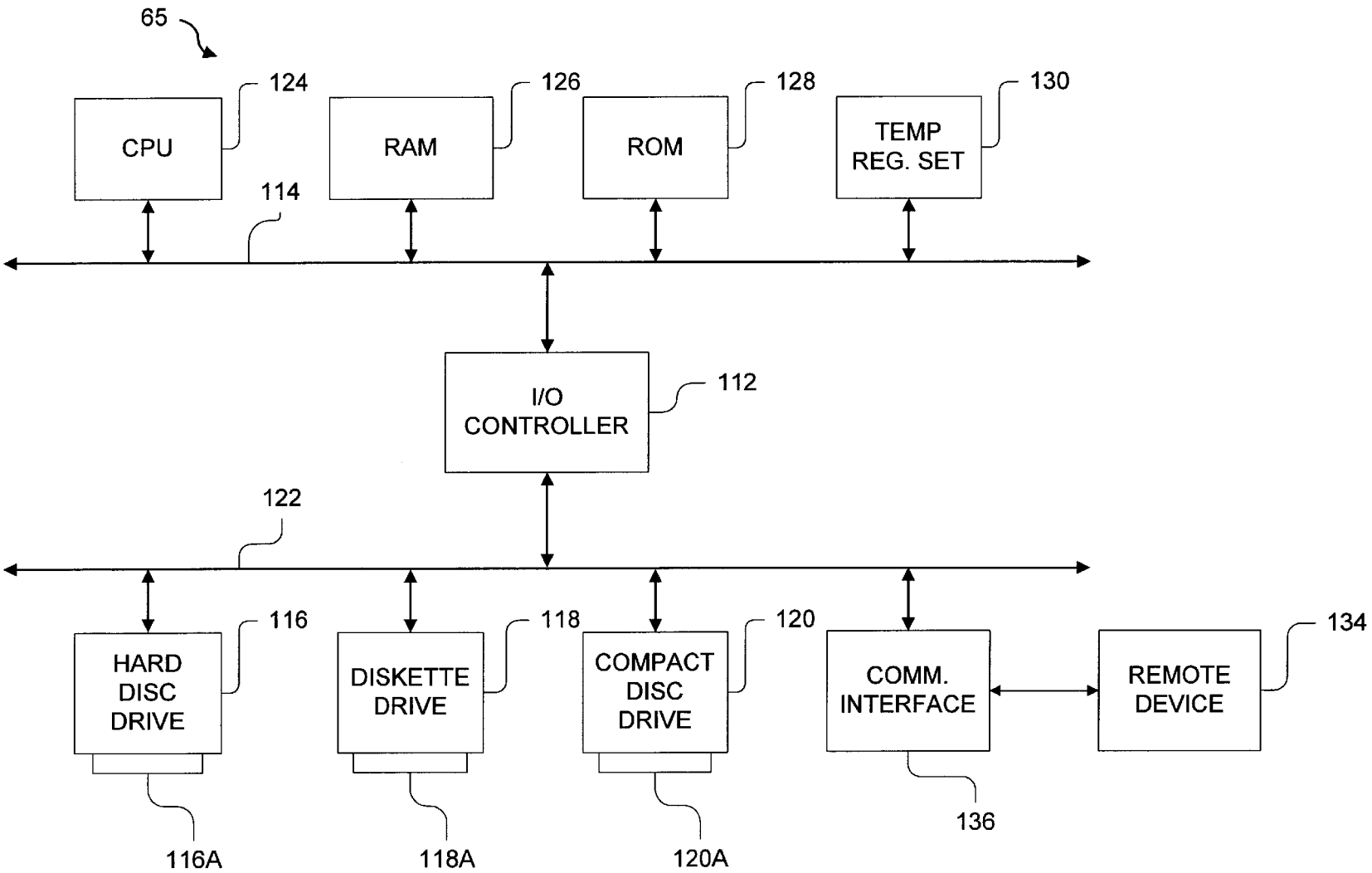
FIG. 13 is a functional block diagram of a host computer connected to the printer of the present invention.

As shown in FIG. 13, host computer 65 may include, for example, a central processing unit (CPU) 124, memories including a random-access-memory (RAM) 126, read-only memory (ROM) 128 and temporary register set 130, and an input/output controller 112, all connected to an internal bus 114. Although for the sake of illustration each of the above units are shown separately, it will be appreciated that these units may be implemented with discrete components, application specific integrated circuits, processors executing appropriate software and the like or any combination thereof.

Operating system software and/or application specific software for operating the host computer 65 and/or the printer 1 and/or the various functional units described herein may be stored in any combination of the memories 126, 128 and 130 or may be stored externally in one or more of the I/O units including hard disc drive unit 116, diskette drive unit 118, and compact disc drive 120, each connected to I/O Bus 122. Software for operating the various functional units and/or for implementing the method of the present invention may be stored on the medium such as hard disc 116A, diskette 118A or compact disc 120A, or may be stored at a remote device 134 and input through communications interface 136. The software program for performing the method of the present invention may be embodied on a carrier wave and input to the host computer through communications interface 136. The remote device may be the internet or a network such as local network (LAN) or wide area network (WAN), for example. The remote device 134 may also include the printer 1 and the communications interface may include an RS-232C port, for example, enabling two-way communication between the host computer and printer interface 104.

Overall Configuration

Figure 1:
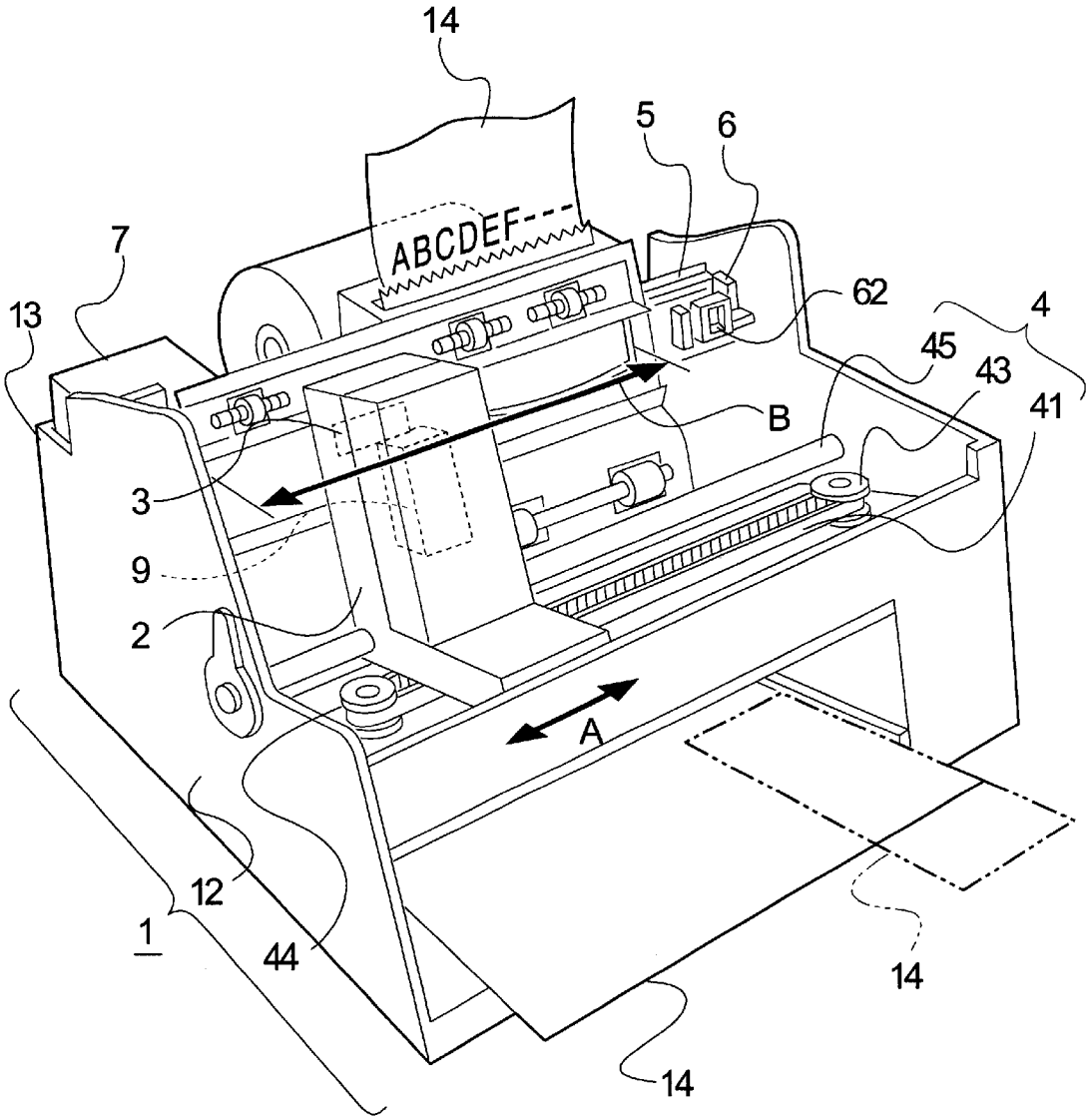
FIG. 1 is a perspective view of an ink jet printer using an ink priming method according to the present invention.

FIG. 1 is a perspective view of an ink jet printer according to a preferred embodiment. FIG. 2 is another perspective view showing the major internal components of the ink jet printer shown in FIG. 1 but from the side opposite to that shown in FIG. 1. As will be appreciated from these figures, an ink jet printer 1 according to this preferred embodiment comprises a print head 3 for ejecting ink droplets, a carriage 2 on which the print head 3 is mounted, a carriage moving mechanism 4 for moving the carriage 2 forward and back in the main scanning direction as indicated by arrow A, and an ink supply mechanism 10 (FIG. 3) for supplying ink to the print head 3.

The rectangular nozzle surface 32 of the print head 3 is exposed through a rectangular opening formed in the carriage 2. Two rows of nozzles, each having a plurality of nozzles 31 arrayed in a line, are formed in this nozzle surface 32.

As shown in FIG. 2, the carriage moving mechanism 4 comprises a guide rail 45 extending along the main scanning direction A, a timing belt 41 engaging a drive pulley 43 and a follower pulley 44, and a carriage motor 42 for rotationally driving the drive pulley 43. The bottom part of the carriage 2 is slidably supported on the guide rail 45, and is linked to the timing belt 41. Driving the carriage motor 42 therefore causes the carriage 2 to move in the main scanning direction along the guide rail 45.

A recording medium 14 is transported in a subscanning direction at a position opposite the nozzle surface 32 of the print head 3 carried by the carriage 2. Information can thus be recorded onto the surface of the recording medium 14 by ejecting ink droplets from the nozzles 31 on the surface of the recording medium 14 while moving the carriage 2 carrying the print head 3 in the main scanning direction over the surface of the recording medium 14.

Ink Supply Mechanism

Figure 3:
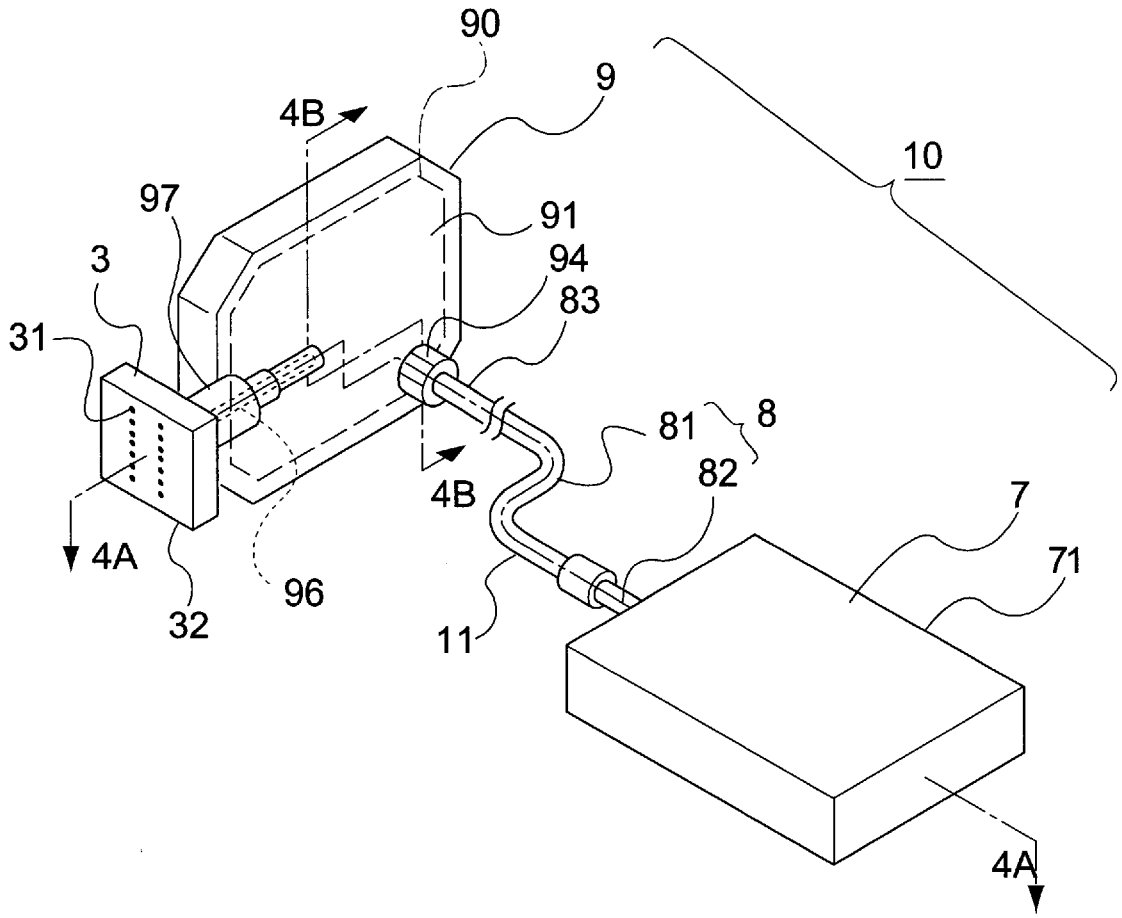
FIG. 3 is a perspective view of the ink supply mechanism in the ink jet printer shown in FIG. 1.
Figure 4:
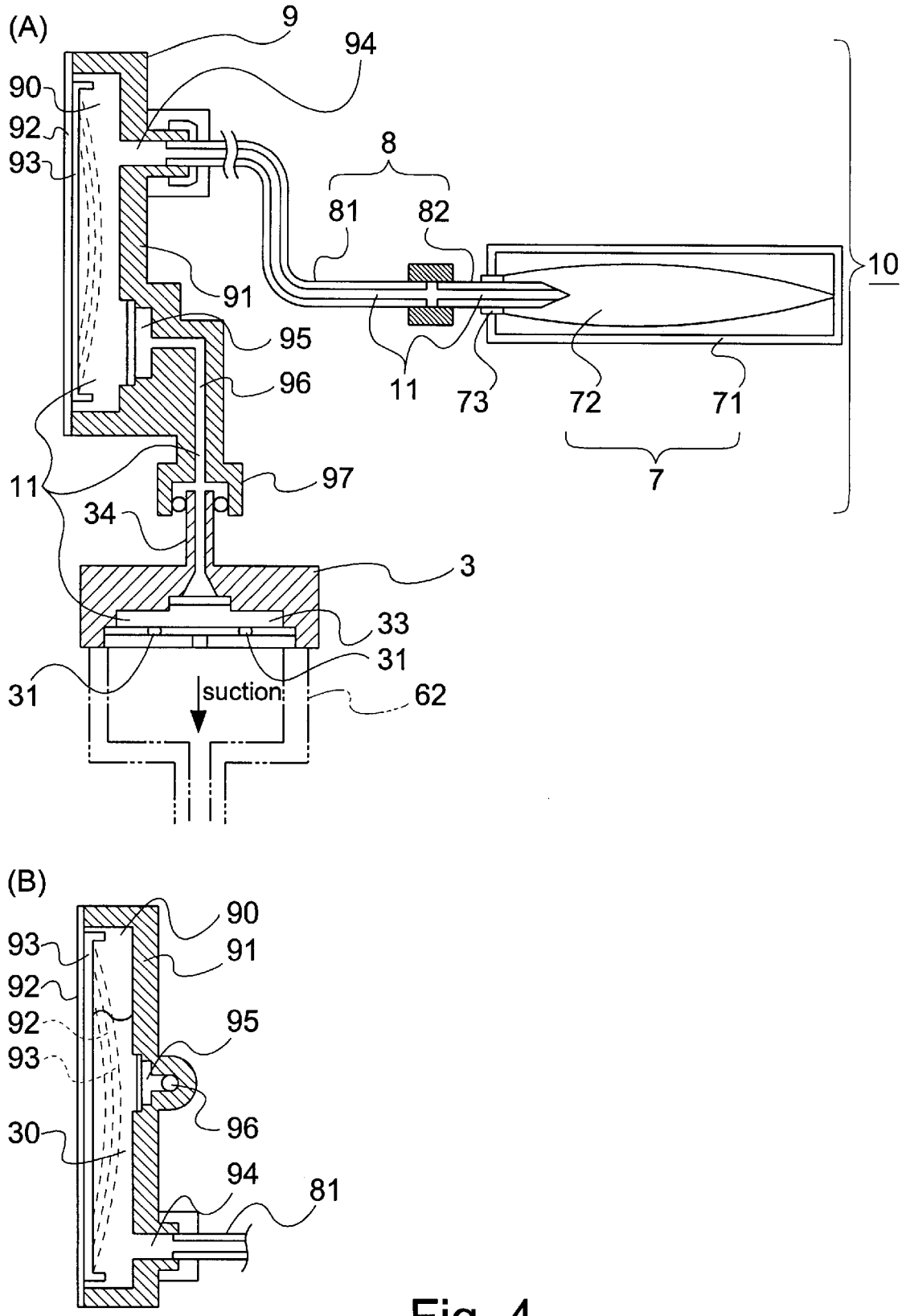
FIG. 4A is a section view through line 4A—4A in FIG. 3.
FIG. 4B is a section view through line 4B—4B in FIG. 3.

FIG. 3 is a perspective view of the ink supply mechanism 10. FIG. 4A is a section view through line 4A—4A FIG. 3, and FIG. 4B is a section view through line 4B—4B in FIG. 3. The ink supply mechanism 10 is described next with reference to FIG. 1 to FIG. 4.

As best shown in FIG. 1 and FIG. 2, the ink supply mechanism 10 comprises an ink cartridge 7, which can be installed in and removed from the ink cartridge holder 13 disposed in the main housing 12 of the ink jet printer 1; a pressure attenuator (damper) 9 mounted on the carriage 2; and an ink supply tube 8 connecting the ink cartridge 7 and pressure attenuator 9.

As shown in FIG. 2, FIG. 3, and FIG. 4(A), the ink cartridge 7 comprises a flat, box-like rigid case 71, and a flexible ink tank 72. The ink tank 72 is housed inside rigid case 71, and is filled with ink. The ink tank 72 has an ink outlet 73, which projects through to the outside of rigid case 71.

The ink supply tube 8 comprises the main ink supply tube 81, and an ink supply needle 82 attached to one end of the main ink supply tube 81. The other end of the main ink supply tube 81 is connected to the pressure attenuator 9. The ink supply needle 82 is inserted into the outlet 73 of the ink cartridge 7. The ink supply needle 82 is inserted into and removed from the outlet 73 in conjunction with installation of the ink cartridge 7.

As shown in FIG. 3 and FIG. 4, the pressure attenuator 9 comprises a flat, cup-shaped, rigid case 91 with a substantially octagonal shape in section as shown in FIG. 3; a soft film 92 attached to the rigid case 91 so as to close the open part of the rigid case 91; and leaf spring 93 affixed to the inside surface of the soft film 92. An ink pressure attenuation chamber 90 is thus formed between the rigid case 91 and soft film 92.

An ink inlet 94 and an ink outlet 95 are formed in the rigid case 91. One end 83 of the main ink supply tube 81 is connected to the ink inlet 94; the ink outlet 95 is linked to one end of an ink outflow channel 96 formed in the rigid case 91. The other end of the ink outflow channel 96 opens to a large diameter print head connector 97.

The print head 3 comprises an ink inlet tube 34 and an ink chamber 33 for holding ink introduced through the ink inlet tube 34. An end of the ink inlet tube 34 is inserted to and held sealed in the print head connector 97. Ink held in the ink chamber 33 is subsequently ejected from the nozzles 31.

With reference to FIG. 4B, a specific quantity of ink 30 is held inside the ink pressure attenuation chamber 90. As the internal pressure of the ink pressure attenuation chamber 90 increases and decreases, the soft film 92 attached to the leaf spring deforms flexibly to the outside or inside, thus changing the internal volume of the ink pressure attenuation chamber 90. This displacement of the soft film 92 holds the internal pressure of the ink pressure attentuation chamber 90 constant. As a result, the ink supply pressure of ink supplied from the ink outlet 95 to the print head 3 remains constant even when the ink pressure at the ink inlet 94 changes.

Ink Suction Mechanism

A head maintenance unit 5 is disposed opposite a print head home position separate from the printing area B of the print head 3 as shown in FIG. 2. An ink suction mechanism 6 is provided in this head maintenance unit 5 for suctioning high viscosity ink and residual bubbles from the ink nozzles of the print head 3.

The ink suction mechanism 6 has a nozzle cap 62 for covering the nozzle surface 32 of print head 3 when the print head 3 is located at the home position. Using carriage movement or the drive power of a motor 52 attached to the casing 50 of the head maintenance unit 5, the nozzle cap 62 can be moved between a retracted position where the nozzle cap 62 is retracted into the casing 50, or a capping position where the nozzle cap 62 projects from the casing 50. The nozzle cap 62 is in the retracted position inside the casing 50 when the print head 3 is in the printing area B.

When the print head 3 reaches the home position, the nozzle cap 62 moves to the capping position projecting from the casing 50, and thus covers the nozzle surface 32 of print head 3 as indicated by the double-dot dash line in FIG. 4A. The pressure inside the cavity thus sealed by the nozzle surface 32 and nozzle cap 62 is then lowered by means of pump 61, which is driven by motor 52. Ink can therefore be suctioned out from the nozzles 31 by thus operating the pump 61 while the nozzle cap 62 covers the nozzle surface 32.

Drive Control of the Ink Suction Mechanism

Drive control of an ink suction mechanism 6 thus comprised is performed by the drive control unit 63 of the ink jet printer 1. The drive control unit 63 includes a microcomputer 68, which runs a control program stored in ROM 69 to control recording medium transportation, printing by the print head, and the ink suction operation of the ink suction mechanism 6. Although drive control unit 63 is shown as a separate block in FIG. 2 for discussion purposes, it may be formed in whole or in part with CPU 103, shown in FIG. 10.

Both a manual cleaning switch 64 and host computer 65 are connected to the drive control unit 63. The ink suction mechanism 6 can thus be operated either by operating the manual cleaning switch 64, or by assertion of an appropriate command from the host computer 65.

The drive control unit 63 comprises both first timer 66 and second timer 67; these timers can be achieved either in hardware or software. The first timer 66 counts the time elapsed from a last ink priming operation, which is described in further detail below. The second timer 67 counts the time elapsed from the last ink suction process performed by the ink suction mechanism 6. Although timers 66 and 67 are shown as separate functional blocks of drive control unit 63 for discussion purposes, they may be formed in whole or in part with timer 106, shown in FIG. 10, and also backed-up by battery 107.

The drive control unit 63 also has a counter Co for counting the number of head recovery processes (which are described in detail below) performed, and the ink priming completion flag FI, which is indicative of whether ink priming has been completed. The ink priming completion flag FI can be stored in EEPROM 108, shown in FIG. 10.

Ink Suction Operation

Figure 5:
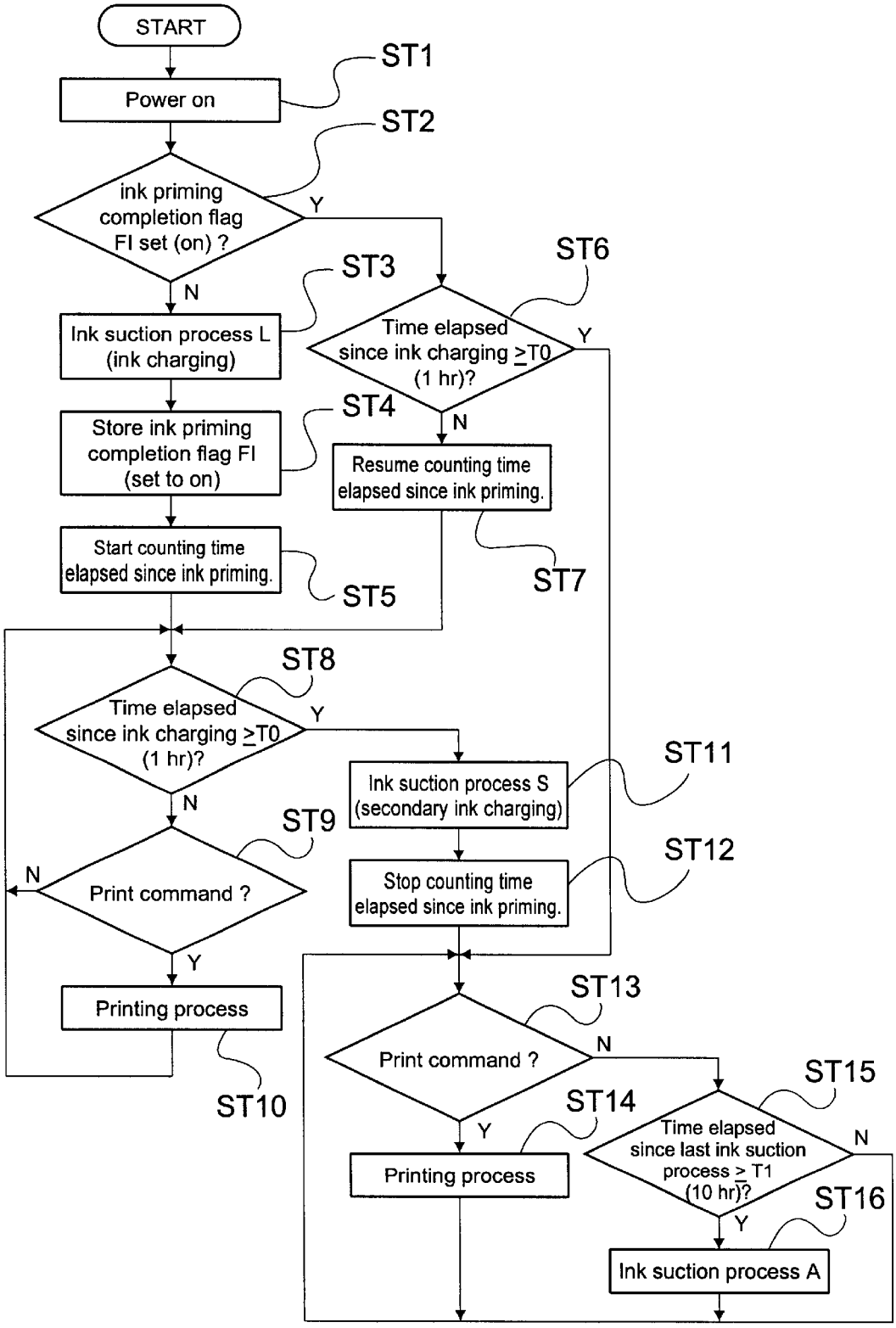
FIG. 5 is a flow chart of an ink suction control process in the ink jet printer shown in FIG. 1.

FIG. 5 is a flow chart of the operation of the ink jet printer 1, showing primarily the ink suction process.

An ink priming process is performed as required using the ink suction mechanism.

A post-priming head recovery process whereby ink is suctioned with greater force than is used during normal nozzle cleaning is performed one hour after ink priming in a preferred embodiment of the invention.

A first head recovery process whereby a small amount of ink is suctioned automatically is performed once ten hours has elapsed after the last ink suction operation.

A second head recovery process is performed when the manual switch is operated to force a head recovery process when desired.

The timing of these processes is described in detail below with reference to the flow chart in FIG. 5.

When the printer power is turned on (step ST1), drive control unit 63 detects whether ink priming has been completed by reading the state of the ink priming completion flag FI (step ST2). If the ink priming completion flag FI is reset (not on), ink priming is determined to have not been completed, and the ink priming process L is performed (step ST3). The ink suction volume V0 of this ink priming process L is set to 15 cc in this exemplary embodiment.

After ink priming process L is thus completed using the ink suction mechanism 6, the ink priming completion flag FI is set (on) (step ST4), and the first timer 66 begins counting (step ST5).

Next, drive control unit 63 detects whether a preset time T0 has elapsed by reading the first timer 66 (step ST8), and continues looping through step ST9 until a print command is received or time T0 has elapsed. If a print command is received, step ST9 advances to the printing process (step ST10). Once the printing process is completed, control loops back to step ST8, and the loop continues.

In this preferred embodiment of the invention time T0 is set to one hour. As a result, the loop from ST8 to ST10 continues for one hour after the ink priming process L is completed.

If the power is turned off while this loop is executing, that is, before the one hour time T0 elapses, and then printer power is turned back on, control flows from step ST1 to decision diamond ST2, which branches to decision diamond ST6, in which drive control unit 63 determines whether one hour has elapsed since the ink priming process L by checking timer 66. If time T0 has not elapsed, the first timer 66 continues counting (step ST7), and the loop of steps ST8 to ST10 resumes.

When time T0 passes, the post-priming head recovery process S (step ST11) is performed. The ink suction volume V1 of this post-priming head recovery process S is 3 cc in this exemplary embodiment.

After the post-priming head recovery process S is performed, the first timer 66 stops (step ST12), and drive control circuit 63 waits for a print command (step ST13). When a print command is received, the printing process is performed (step ST14), and control loops back to decision diamond ST13.

If no print command is received (ST13=no), drive control unit 63 determines whether a first time T1 has elapsed since the last ink suction process performed (step ST15). In this case the last ink suction process was the post-priming head recovery process. Note, also, that this first time T1 compared to the time is counted by the second timer 67. In this exemplary embodiment this first time T1 is set to ten hours so that a first normal head recovery process A (step ST16) is performed when ten hours has passed since the last ink suction process. Note, further, that the ink suction volume V2 of this first normal head recovery process A is set to 0.1 cc. As a result, 0.1 cc of ink is suctioned to clean and restore the print head every ten hours after the post-priming head recovery process S is performed.

If the printer power is turned off and then on again while in this loop counting up to first time T1, step ST6 passes control to decision diamond ST13 because one hour has elapsed since the ink priming process L was completed and the post-priming head recovery process S has been performed (i.e., at least one hour had already passed since the ink priming process when power was turned off and then back on). The loop from ST13 to ST16 therefore resumes.

In this preferred embodiment the ink suction volume V1 of the post-priming head recovery process S is greater than the ink suction volume V2 of the first normal head recovery process A. Any residual bubbles in the ink path 11 can therefore be reliably expelled from the nozzles 31 by performing just a single post-priming head recovery process S.

In addition, this post-priming head recovery process S is performed one hour after ink priming has been completed in this exemplary embodiment. The post-priming head recovery process S is therefore performed after bubbles adhering to the inside walls of the ink path 11 after ink priming have separated from the walls, and the bubbles can therefore be reliably expelled from the ink path. It is therefore possible to reliably prevent printing defects arising from bubbles remaining in the ink path 11 after ink priming.

An Alternative Ink Suction Process

FIGS. 6 to 9 are flow charts of an alternative ink suction control process in an ink jet printer according to the present invention.

The ink suction control process according to this embodiment of the invention performs the post-priming head recovery process S up to three times after ink priming. During normal operation, the first normal head recovery process A, in which a small volume of ink is expelled, is performed at regular ten hour intervals after the last ink suction process. But, if a week or more has elapsed since the last ink suction process (e.g. where the printer is turned off for eight days and then turned back on), a high volume third normal head recovery process B, whereby a large volume of ink is expelled, is performed. Other aspects of the control procedure are basically the same as shown in FIG. 5 and described above.

Figure 6:
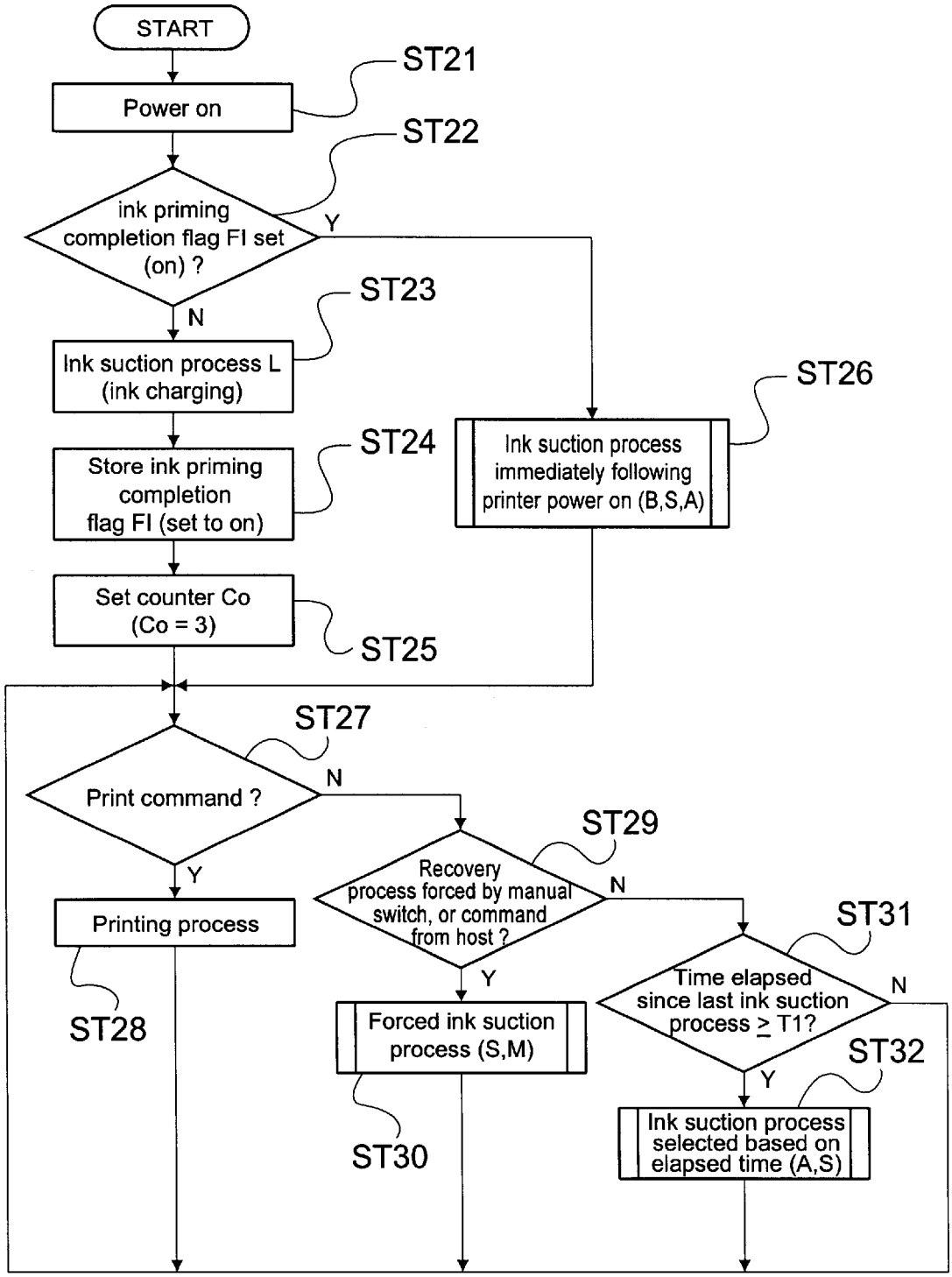
FIG. 6 is a flow chart of an alternative ink suction control process in the ink jet printer shown in FIG. 1.

Referring to FIG. 6, when the power is turned on (step ST21), the drive control unit 63 determines whether the ink priming completion flag FI is set (on) to detect whether the ink priming process L has been completed (step ST22). If the ink priming completion flag FI is not set (not on), the ink priming process L has not been performed, and is therefore started (step ST23). The ink suction volume V0 of this ink priming process L is 15 cc. When the ink priming process L ends, the ink priming completion flag FI is set (on) (step ST24), and a counter Co is set to a predefined value (step ST25). This predefined value is 3 is this exemplary embodiment.

The drive control unit 63 then waits for a print command (step ST27), and passes control to the printing process (step ST28) when a command is detected. If a print command is not detected, drive control unit 63 detects whether a head recovery process has been specified by a command asserted either by operating the manual cleaning switch 64 or by the host computer 65 (step ST29). If a head recovery process command is not detected, drive control unit 63 detects whether the time elapsed since the last ink suction process equals or exceeds a first time T1 (step ST31). This elapsed time is counted by the second timer 67.

In this exemplary embodiment this first time T1 is set to ten hours. Therefore, if ten hours has not passed, decision diamond ST31 loops back to print command detection in ST27, and the above-described process is repeated.

Figure 7:
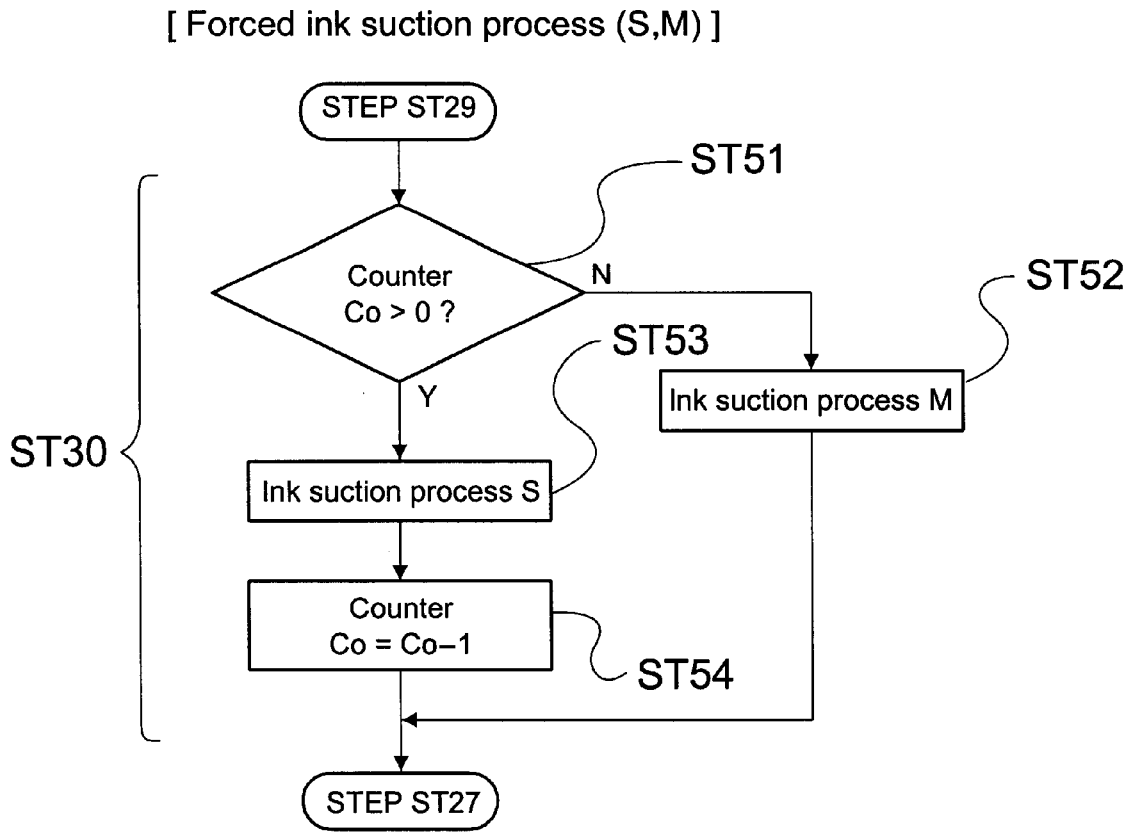
FIG. 7 is a flow chart of the ink suction process shown in FIG. 6 forced by a head recovery process command.

If a head recovery process command is asserted either by operation of the manual cleaning stitch 64 or by the host computer 65 at step ST29 in this loop, the ink suction process initiated by a head recovery process command is performed as shown in FIG. 7 (step ST30). Note that the head recovery process in this case includes both the second normal head recovery process M and post-priming head recovery process S.

Figure 8:
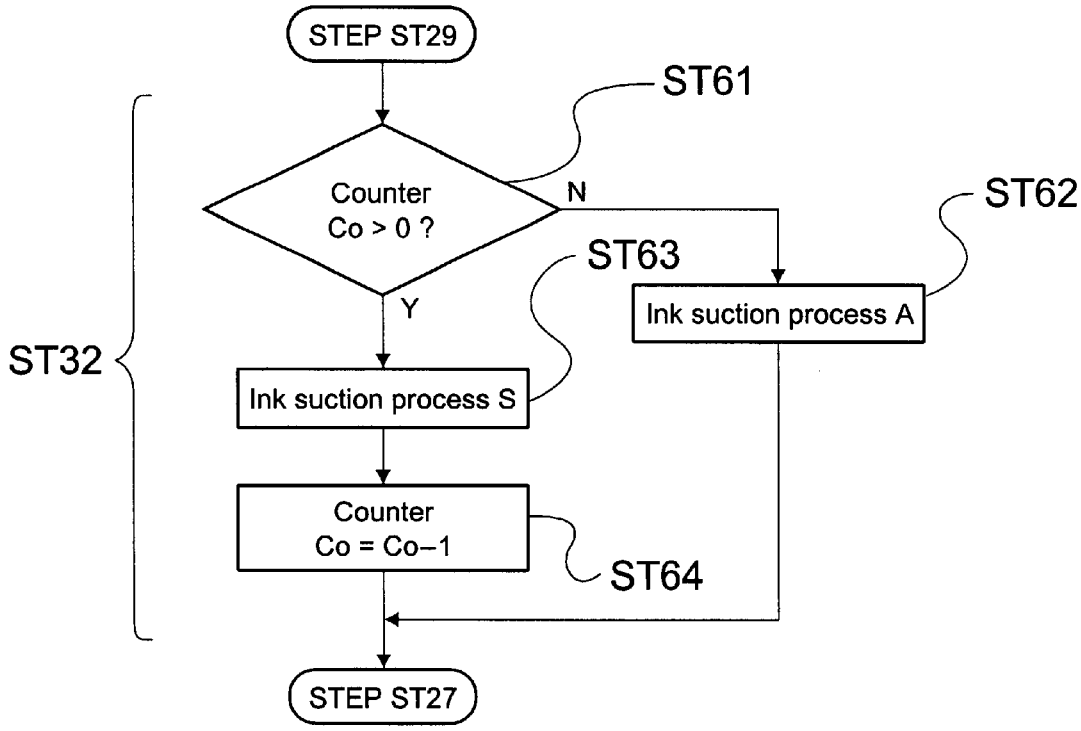
FIG. 8 is a flow chart of the ink suction process shown in FIG. 6 initiated by the passage of a specific time period.

If a head recovery process command is not asserted but first time T1 has elapsed in step ST31, that is, ten hours have elapsed since the last ink suction process, the ink suction process as shown in FIG. 8 is performed. Note that the ink suction process in this case includes first normal head recovery process A and post-priming head recovery process S.

The ink suction process (step ST30) initiated by a head recovery process command or activation by manual cleaning switch 64 is described next with reference to the flow chart in FIG. 7. Referring to FIG. 7, when the ink suction process is initiated by a head recovery process command or activation of manual cleaning switch 64, drive control unit 63 detects whether counter Co is greater than zero (step ST51). If it is, the post-priming head recovery process S is performed (step ST53), the counter Co is decremented one (step ST54), and the ink suction process is ended. However, if the counter Co is 0, the second normal head recovery process M is performed (step ST52); the ink suction process initiated by an asserted head recovery process command or activation of manual cleaning switch 64 then ends.

When a head recovery process is initiated by operation of the manual cleaning switch 64 or by the host computer 65, the post-priming head recovery process S is thus repeated if the post-priming head recovery process S has not been performed three times. If the post-priming head recovery process S has been performed three times, the second normal head recovery process M is performed.

It should be noted that the ink suction volume V1 of the post-priming head recovery process S is 3 cc, and the ink suction volume V3 of the second normal head recovery process M is 1 cc in this exemplary embodiment.

FIG. 8 is a flow chart of the ink suction process performed in step ST32 in FIG. 6 when first time T1 has elapsed. This ink suction process similarly starts by evaluating the counter Co (step ST61). If the value of the counter Co is greater than zero, the post-priming head recovery process S is performed (step ST63), the counter Co is then decremented one (step ST64), and the ink suction process ends. However, if the counter Co is 0, the first normal head recovery process A is performed (step ST62); the ink suction process initiated when first time T1 has elapsed then ends.

The post-priming head recovery process S is therefore performed ten hours after the last ink suction process unless the post-priming head recovery process S has already been performed three times. If the post-priming head recovery process S has already been performed three times, the first normal head recovery process A is performed. It should be noted that the ink suction volume V2 in this first normal head recovery process A is set to 0.1 cc.

Figure 9:
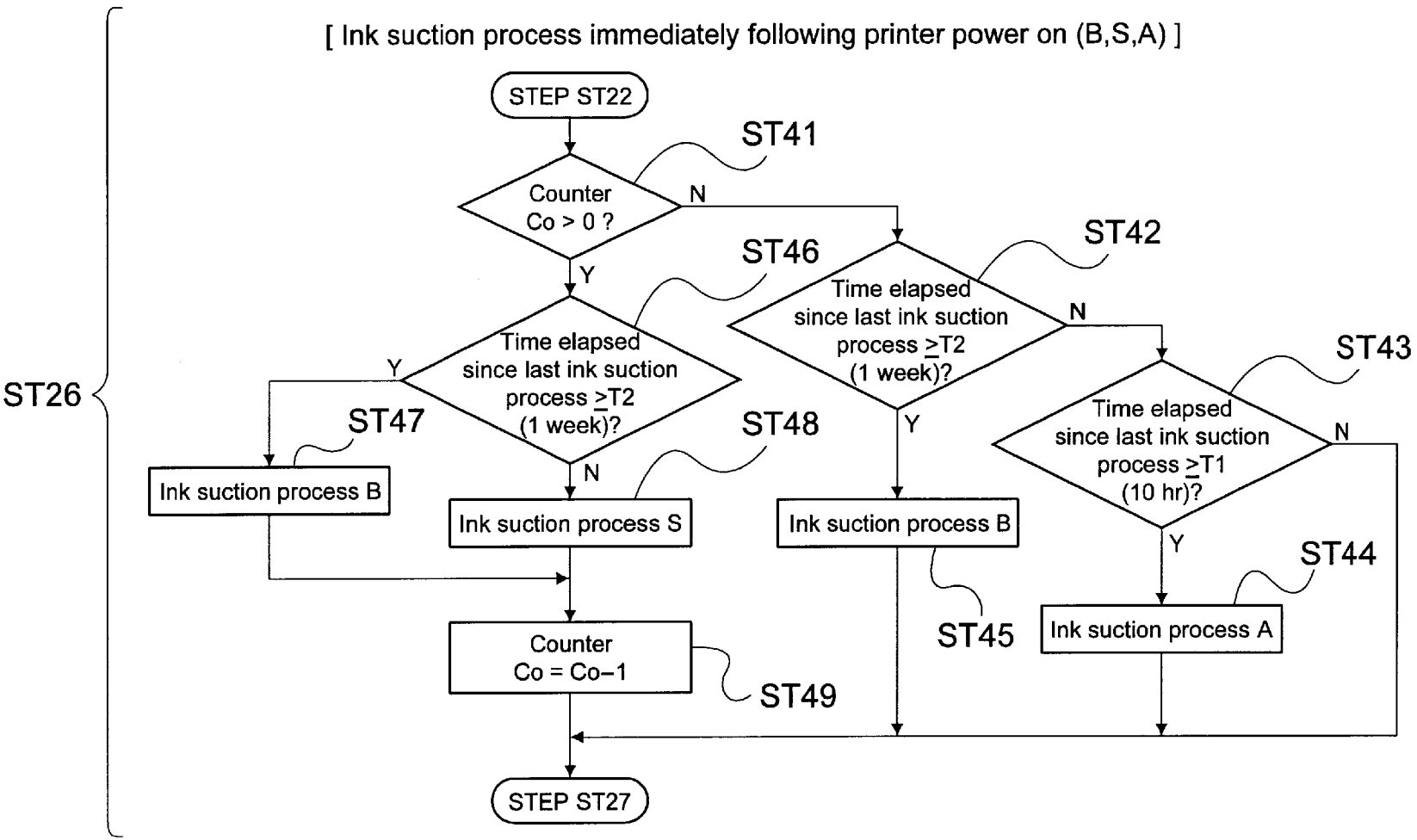

Returning again to FIG. 6, if ink priming has already been performed when the printer power is turned on, the ink suction process performed immediately after power is turned on is determined as shown by the flow chart in FIG. 9 (step ST26).

Referring now to FIG. 9, the first step in this routine is to evaluate the value of counter Co (step ST41). If the value of counter Co is zero, the post-priming head recovery process S has already been performed three times. Drive control unit 63 then determines whether the time elapsed since the previous ink suction process equals or exceeds a second time T2 (step ST42). Note that this elapsed time is counted by second timer 67, and the second time T2 is set to one week in this exemplary embodiment.

If the elapsed time since the last ink suction process is less than one week, drive control unit 63 determines whether the elapsed time equals or exceeds a first time T1 based on the value of the second timer 67 (step ST43). Note that this first time T1 is ten hours as described above. If this elapsed time since the last ink suction process is less than ten hours, step ST26 ends.

However, if the time elapsed from the last ink suction process is one week or more in ST42, the third normal head recovery process B is performed (step ST45). If a week or more has passed since the last ink suction process, viscous ink or a large number of residual bubbles will be present in the ink path 11. Therefore, if the ink is not purged from the ink path 11, it may not be possible to restore the ink in the print head 3 to a normal condition. The ink suction volume V4 of this third normal head recovery process B is therefore 7 cc in this exemplary embodiment, that is, greater than the ink suction volume V1 of the post-priming head recovery process S.

Furthermore, if the time elapsed since the last ink suction process is less than a week but ten or more hours, the first normal head recovery process A described above is performed (step ST44).

If the value of the counter Co is greater than zero in ST41, the post-priming head recovery process S has still not been performed three times. Drive control unit 63 therefore determines whether the elapsed time since the last ink suction process counted by the second timer 67 equals or exceeds the above-noted second time T2 (one week) (step ST46). If it is less than one week, the post-priming head recovery process S is performed (step ST48), the counter Co is decremented one (step ST49), and the procedure ends.

If the elapsed time is a week or greater, however, the third normal head recovery process B is performed (step ST47) to suction a large volume of ink. The counter Co is then decremented one, and the procedure returns.

Any residual bubbles in the ink path can thus be reliably purged using the ink suction control process of this exemplary embodiment because the post-priming head recovery process suctioning a large volume of ink is repeatedly performed after ink priming.

In addition, a third normal head recovery process is also performed to suction a large volume of ink if the printer is left without printing for a week or more since the last ink suction process. It is therefore possible to resume printing without suffering print defects even when printing is first resumed after leaving the print head unused for an extended period of time.

A Further Alternative Embodiment

Power supply to the timer 106 is maintained by the backup battery 107 when the power switch 109 is turned off and the main power supply to the ink jet printer is interrupted after ink priming. It is therefore possible to initiate the post-priming head recovery process once an hour has elapsed following ink priming after the power is turned on.

Figure 12:
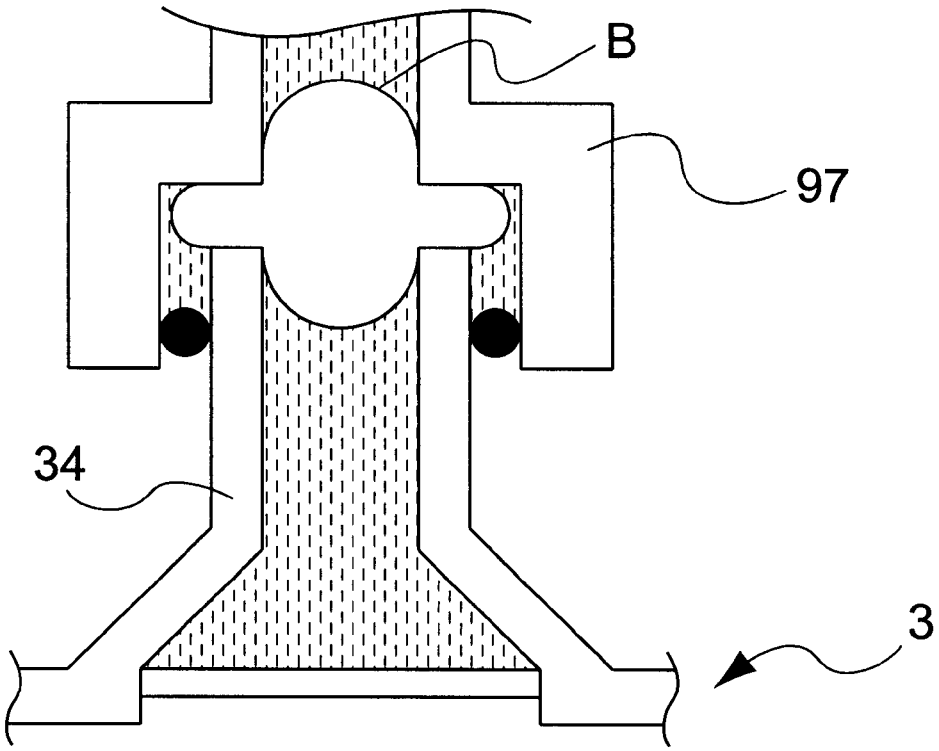
FIG. 12 illustrates occlusion (block) of the ink path by a bubble.

It is preferable to perform the post-priming head recovery process an hour after ink priming because the fine bubbles trapped in parts of the ink path as described above tend to accumulate and combine into a number of large bubbles within an hour. Bubble size grows gradually after ink priming. After about an hour, the bubbles will grow to a size sufficient to block the ink path, thus stopping ink supply to the print head, and causing missed dots (nonfiring nozzles). See FIG. 12.

It is assumed below that the ink supply tube diameter is 1.4 mm and the largest diameter at an offset in the ink path is 3.3 mm. Assuming these common parameters, bubble size will grow gradually after ink priming as shown in the following table.

TABLE 1

Bubble growth over time after ink priming

| Time (min) | Bubble size (mm) | Bubble count | Bubble state |
|---|---|---|---|
| 0 | 0.2–0.3 | numerous | in offsets; not in flow path |
| 10 | 1.0 | 10> | in offsets; not in flow path |
| 20 | 1.4 | 2–3 | in both offsets and flow path |
| 30 | 2.0 | 2 | in both offsets and flow path |
| 40 | 2.4 | 2 | in both offsets and flow path |
| 50 | 2.8 | 2 | in both offsets and flow path |
| 60 | 3.3 | 1 | completely occluding flow path |
| 70 | 3.3 | 1 | completely occluding flow path |
| 80 | 3.3 | 1 | completely occluding flow path |

As noted in the above table, the bubbles gather in offsets in the ink path while the bubble size is on the order of 0.2 mm, and are not picked up by the ink flow. Bubbles of this size therefore do not reach the nozzles or ink chamber, and therefore do not prevent ink from being ejected from the nozzles, that is, print defects due to bubbles in the ink path do not occur at this stage. Furthermore, even if some of these small bubbles do appear in the ink path, the bubbles float in the ink path and do not reach the ink chamber.

However, when the bubbles coalesce into a single 3.3 mm bubble, a bubble trapped in an ink path offset protrudes into the flow path, completely blocking the entire ink supply tube. The bubble thus completely occludes the ink flow path, and prevents ink from being supplied to the nozzles. A low volume ink suction process at this time can carry the bubble from the ink path to the ink chamber. However, a normal low volume ink suction process will allow the bubble to stop in the ink chamber and will not expel the bubble from a nozzle. The bubble thus becomes trapped and cannot be expelled from the ink chamber of an ink jet head according to the present invention whereby ink is ejected from the nozzles by deflection of a pressure chamber.

Figure 11:
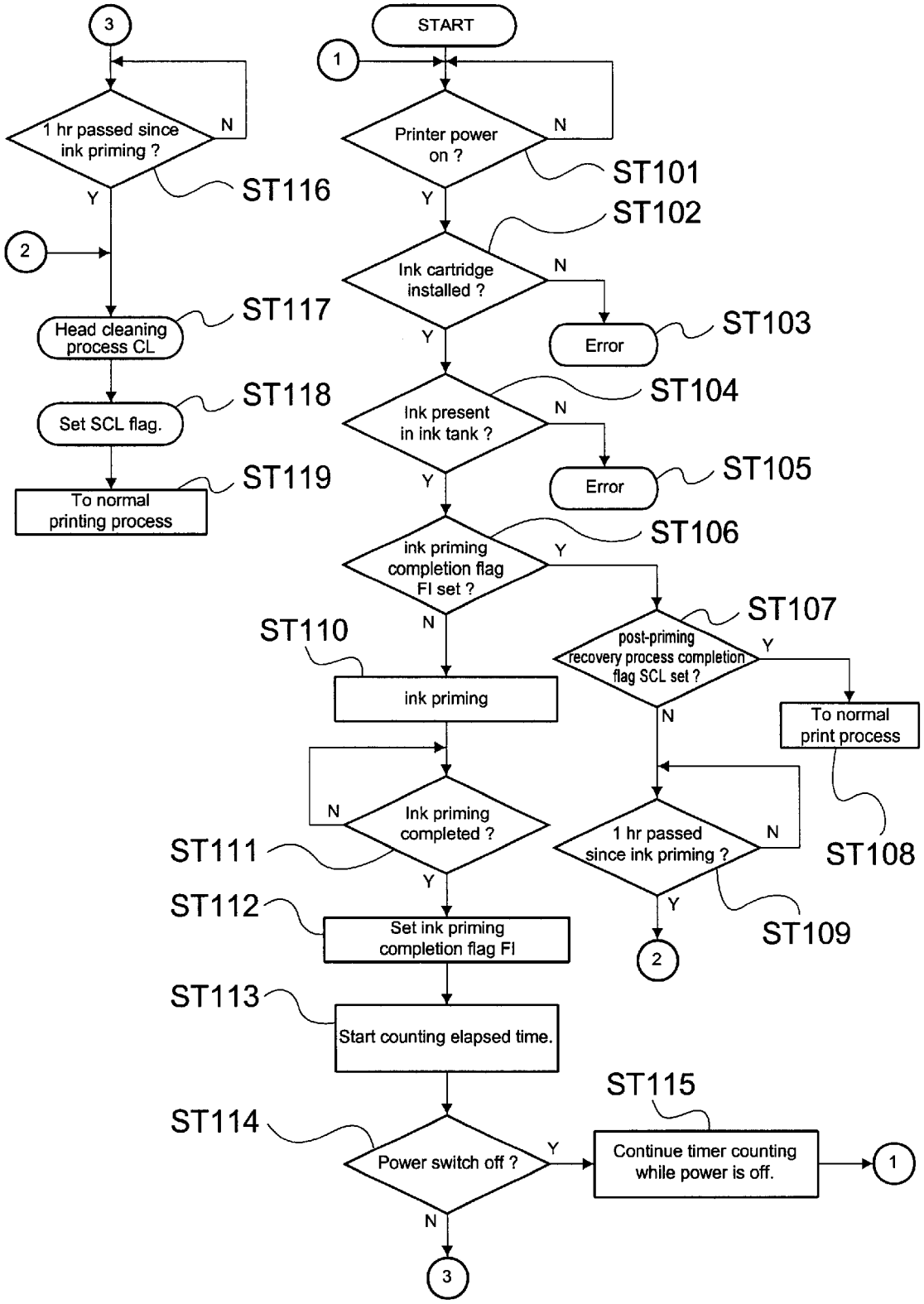
FIG. 11 is a flow chart used to describe a further alternative embodiment of the present invention.

A process as shown in FIG. 11 and described below is therefore used to prevent this. Note that the flow chart in FIG. 11 illustrates a further alternative embodiment of the present invention.

The ink priming completion flag FI and post-priming recovery process completion flag SCL are cleared(reset) before the process shown in the flow chart in FIG. 11 begins, that is, before the ink jet printer is shipped from the factory to the end-user.

As noted above, the timer 106 is backed up by a backup battery 107 so that the timer 106 continues operating even when the main power supply is off. The timer 106 starts operating when the ink priming completion flag FI is set. The timer 106 begins a separate timer count after manual cleaning operations and normal ink suction processes. Timer 106 may include, for example, a real-time-clock, counters, registers, etc., under CPU 103 control.

When the process shown in FIG. 11 then starts, CPU 103 waits for the printer power to be turned on (step ST101). When the printer power is turned on (ST101=yes), CPU 103 determines from ink cartridge detector 101 whether the ink cartridge is correctly installed (step ST102). If not (ST102=no), a "no cartridge warning" is issued (ST103).

If the ink cartridge is installed (ST102=yes), CPU 103 determines from ink end detector 102 whether there is any ink in the ink tank (ST104). If there is substantially no ink left in the tank (ST104=no; ink end), an "ink end warning" is issued (ST105).

If there is ink in the ink tank (ST104=yes), CPU 103 determines whether the ink priming completion flag FI is set (step ST106). Note that this flag FI is stored in EEPROM 108 or other nonvolatile memory. If the ink priming completion flag FI is not set (ST106=no), the ink priming process is initiated (step ST110). This ink priming process in step ST110 pumps only enough ink from the ink cartridge to fill the ink path to the nozzles, that is, approximately 15 ml in this exemplary embodiment. Step ST111 waits for the required initial ink charge.

The ink suction volume is substantially proportional to the ink suction time, and the required amount of ink can therefore be suctioned to the nozzles by controlling the ink pump operating time using an appropriately set timer. Because the ink pump is driven by a stepping motor, and the ink suction volume is also substantially proportional to the number of steps the stepping motor is driven, the required amount of ink can alternatively be suctioned to the nozzles by controlling the number of steps this stepping motor is driven. The CPU 103 in step ST111 can therefore determine whether ink priming is completed by monitoring the value of the preset timer 106, or detecting whether the number of steps taken by the stepping motor has reached the predetermined step count. As previously mentioned, timer 106 may include, for example, a real-time-clock, counters, registers, etc.

When ink priming is completed (ST111=yes), the ink priming completion flag FI is set (ST112), and the timer 106 starts a count used for measuring the time elapsed since ink priming (ST113).

If the ink jet printer power switch is turned off (ST114=yes) before this elapsed time count of the timer 106 reaches one hour, the timer 106 continues counting this elapsed time count (ST115) until printer power is turned on again. ST115 thus loops back to ST101 and waits for a power on state. Once power is turned back on, control flows to step ST106, which is now "yes", and then to step ST107. If an hour elapses since ink priming (ST109=yes) and before the post-priming head recovery process is performed (flag SCL remains cleared; ST107=no) while the power was off, a cleaning process CL following ink priming is performed (jump to step ST117). However, if an hour did not pass while the printer power was off, ST109 loops back to continue waiting for an hour to pass. When an hour has elapsed and ST109 then returns yes, the same cleaning process (jump to ST117) is performed.

On the other hand, if ink priming is completed (ST111=yes) and an hour passes with the printer power remaining on (ST116=yes), the same post-priming head recovery process CL (ST117) is performed. This head recovery process suctions 3 ml of ink, a volume sufficient to eject ink bubbles that have grown from the ink nozzles. The post-priming recovery process completion flag SCL is then set (ST118), and the ink priming process returns control to the normal printing process (ST119).

When the printer power is next turned on, the printer is initialized (ST102, ST104), and CPU 103 detects whether the ink priming completion flag FI is set (step ST106). If the flag FI is set (ST106=yes), CPU 103 detects whether the post-priming recovery process completion flag SCL is set (step ST107). As the flag SCL is now set (ST107=yes), control passes to the normal printing process (ST108).

The ink suction volume ejected from the nozzles 31 in this exemplary embodiment is as follows.

(1) For ink priming, 15 ml of ink is suctioned from the ink tank to fill the ink path to the nozzles.

(2) For the post-priming head recovery process CL performed one hour after ink priming, 3 ml of ink is ejected from the nozzles.

(3) The time elapsed from each ink suction process is counted by timer 106 even when the main printer power is off; when a week or more has passed since the last ink suction process, 7 ml of ink is suctioned from the nozzles in ink suction process B.

(4) When the elapsed time tracked (counted) by timer 106 is ten or more hours and less than one week, 0.1 ml of ink is suctioned from the nozzles in ink suction process A.

(5) When the manual cleaning switch 64 is turned on, 1 ml of ink is suctioned from the nozzles in ink suction process M regardless of the current count of timer 106.

It should be noted that ink suction processes B, A, and M noted in (3), (4), and (5) above have no relationship to the problem of bubble formation and growth during ink priming, and the passage of bubbles from ink path offsets into the ink flow, and further detail thereof is thus omitted below.

Other Alternative Embodiments

The post-priming head recovery process described above can be alternatively performed immediately after ink priming and at regular intervals thereafter as an ink suction process.

The ink suction volume used for the post-priming head recovery processes should also be optimized according to the specific volume of the ink path to which the process is being applied. The time elapsed after ink priming shall also obviously not be limited to one hour as described in the above exemplary embodiments of the present invention, and should be optimally set according to the various parameters of the ink jet printer in which the ink priming method of the invention is applied.

Each of the methods of the present invention are implemented, in one embodiment, in a software program or programs outlined in the flow diagrams and their accompanying descriptions set forth above. The software program or programs may be resident on the host computer 65, e.g., in ROM 128 or RAM 126, or stored on media such as hard disc 116A, diskette 118A or compact disc 120A, or may be stored at a remote device 134 and input through communications interface 136. The software program for performing the method of the present invention may be embodied on a carrier wave and input to the host computer through communications interface 136.

Benefits of the Invention

An ink priming method for an ink jet printer according to the present invention can thus reliably expel the large number of bubbles that are present in the ink path immediately following ink priming. As a result, printing defects resulting from such residual bubbles can be reliably avoided.

Bubbles remaining in the ink path after ink priming can also be reliably expelled from the nozzles, and printing defects attributable to such residual bubbles can be reliably prevented, because a post-priming head recovery process as described above is performed after a specific time has elapsed following ink priming.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An ink jet printer comprising:

a print head comprising an ink nozzle that ejects an ink droplet;

an ink tank that stores ink;

an ink path that supplies ink from the ink tank to the print head; and an ink suction unit comprising an ink pump and a nozzle capping member that suctions ink from the ink nozzle; and a drive control unit that detects whether ink priming is completed and, if ink priming is not completed, controls the ink suction unit to initially prime the print head by charging ink from the ink tank to the print head by way of the ink path, and to automatically perform post-priming head recovery by suctioning ink from the print head after a predetermined post-priming head recovery time period has elapsed.

2. The ink jet printer as set forth in claim 1, further comprising a regular head recovery timer that counts time from a last ink suction of the print head and wherein the drive control unit is responsive to the regular head recovery timer to control the ink suction unit to subsequently perform periodic regular head recovery by suctioning ink from the print head after a predetermined regular head recovery time has been counted by the regular head recovery timer, and wherein the drive control unit controls ink suction volume of the post-priming head recovery to be greater than ink suction volume of the periodic regular head recovery.

3. The ink jet printer as set forth in claim 2, further comprising a battery that backs-up power to said regular head recovery timer to enable counting of time from a last ink suction even after the printer has been turned off.

4. The ink jet printer as set forth in claim 1, further comprising a post-priming head recovery timer that counts time for completion of priming the print head and wherein the drive control unit is responsive to the post-priming head recovery timer to control the ink suction unit to perform the post-priming head recovery after a predetermined post-priming head recovery time period has been counted by the post-priming head recovery timer.

5. The ink jet printer as set forth in claim 4, further comprising a battery that backs-up power to said post-priming head recovery timer to enable counting of time from completion of priming even after the printer has been turned off.

6. The ink jet printer as set forth in claim 1, wherein the drive control unit controls the ink suction unit to subsequently repeat the post-priming head recovery process a plurality of times.

7. The ink jet printer as set forth in claim 6, further comprising a counter that counts the number of times said post-priming head recovery process is performed.

8. The ink jet printer as set forth in claim 1, wherein the amount of ink suctioned in the post-priming head recovery is less than the amount of ink suctioned to initially prime the print head.

9. The ink jet printer as set forth in claim 1, further comprising an ink priming completion flag for providing an indication of whether ink priming has been completed.

10. An ink priming method for a print head of an ink jet printer, comprising:

detecting whether ink priming has been completed;

an ink priming step of initially charging ink through an ink path that supplies ink to an ink nozzle of the print head if it is detected that ink priming has not been completed;

counting time from the ink priming step;

determining if a predetermined post-priming head recovery time period has elapsed since the ink priming step; and automatically performing a post-priming head recovery process that suctions ink from an ink nozzle after the predetermined post-priming head recovery time period has elapsed.

11. The ink priming method for a print head of an ink jet printer as set forth in claim 10, further comprising:

counting time from a last ink suctioning of the print head;

determining if a predetermined regular head recovery time has elapsed since the last ink suctioning of the print head; and subsequently performing periodic regular head recovery after the predetermined regular head recovery time period has elapsed by recovering ink from the print head with an ink suction volume that is less than an ink suction volume in the post-priming head recovery process.

12. The ink priming method for a print head of an ink jet printer as set forth in claim 10, further comprising repeating the post-priming head recovery process a plurality of times.

13. The ink priming method for a print head of an ink jet printer as set forth in claim 10, wherein the amount of ink suctioned in the post-priming head recovery is less than the amount of ink suctioned to initially prime the print head.

14. The ink priming method for a print head of an ink jet printer as set forth in claim 10, further comprising setting an ink priming completion flag after said ink priming step.

15. An ink jet printer comprising:

an ink tank that stores ink;

an ink jet head comprising a nozzle that ejects ink to print a character on a printing medium;

an ink path that supplies ink from the ink tank to the ink jet head;

an ink suction unit comprising an ink pump and a nozzle capping member that suctions ink from the nozzle;

an ink priming completion indicator that is set after completion of priming the ink jet head;

a post-priming head recovery timer that counts time from completion of priming the ink jet head and setting of the ink priming completion indicator; and a drive control unit responsive to the post-priming head recovery timer to automatically control the ink suction unit to perform post-priming head recovery by suctioning a predetermined amount of ink from the ink jet head after a predetermined post-priming head recovery time period has been counted by the post-priming head recovery timer, the post-priming head recovery time period being commensurate with a time period in which a bubble left in the ink path during ink priming expands to a predetermined size.

16. The ink jet printer as set forth in claim 15, wherein the ink path comprises an offset structure where a diameter of the ink path changes in a step-like manner, the offset structure being in the ink path between the ink tank and the nozzle, and wherein the predetermined amount of ink is suctioned after the predetermined time period in which the bubble grows to a size completely covering the offset structure.

17. The ink jet printer as set forth in claim 15, wherein the amount of ink suctioned in the post-priming head recovery is less than the amount of ink suctioned to initially prime the print head.

18. The ink jet printer as set forth in claim 15, wherein the ink priming completion indicator comprises an ink priming completion flag.

19. A computer program embodied on a computer-readable medium for implementing an ink priming method for a print head of an ink jet printer, the method comprising:

detecting whether ink priming has been completed;

an ink priming step of initially charging ink through an ink path that supplies ink to an ink nozzle of the print head if it is detected that ink priming has not been completed;

counting time from the ink priming step;

determining if a predetermined post-priming head recovery time period has elapsed since the ink priming step; and automatically performing a post-priming head recovery process that suctions ink from an ink nozzle after the predetermined post-priming head recovery time period has elapsed.

20. A computer program embodied on a computer-readable medium for implementing an ink priming method as set forth in claim 19, further comprising:

counting time from a last ink suctioning of the print head;

determining if a predetermined regular head recovery time has elapsed since the last ink suctioning of the print head; and subsequently performing periodic regular head recovery after the predetermined regular head recovery time period has elapsed by recovering ink from the print head with an ink suction volume that is less than an ink suction volume in the post-priming head recovery process.

21. The computer program embodied on a computer-readable medium for implementing an ink priming method as set forth in claim 19, wherein the amount of ink suctioned in the post-priming head recovery is less than the amount of ink suctioned to initially prime the print head.

22. The computer program embodied on a computer-readable medium for implementing an ink priming method as set forth in claim 19, further comprising setting an ink priming completion flag after said ink priming step.

23. A computer program embodied in a carrier wave for implementing an ink priming method for a print head of an ink jet printer, the method comprising:

detecting whether ink priming has been completed;

an ink priming step of initially charging ink through an ink path that supplies ink to an ink nozzle of the print head if it is detected that ink priming has not been completed;

counting time from the ink priming step;

determining if a predetermined post-priming head recovery time period has elapsed since the ink priming step; and automatically performing a post-priming head recovery process that suctions ink from an ink nozzle after the predetermined post-priming head recovery time period has elapsed.

24. A computer program embodied in a carrier wave for implementing an ink priming method as set forth in claim 23, further comprising:

counting time from a last ink suctioning of the print head;

determining if a predetermined regular head recovery time has elapsed since the last ink suctioning of the print head; and subsequently performing periodic regular head recovery after the predetermined regular head recovery time period has elapsed by recovering ink from the print head with an ink suction volume that is less than an ink suction volume in the post-priming head recovery process.

25. The computer program embodied in a carrier wave for implementing an ink priming method as set forth in claim 23, wherein the amount of ink suctioned in the post-priming head recovery is less than the amount of ink suctioned to initially prime the print head.

26. The computer program embodied in a carrier wave for implementing an ink priming method as set forth in claim 23, further comprising setting an ink priming completion flag after said ink priming step.

27. An ink jet printer comprising:

a print head comprising an ink nozzle that ejects an ink droplet;

an ink tank that stores ink;

an ink path that supplies ink from the ink tank to the print head; and an ink suction means for suctioning ink from the ink nozzle; and a drive control means for detecting whether ink priming is completed and, if ink priming is not completed, for controlling the ink suction means to initially prime the print head by charging ink from the ink tank to the print head by way of the ink path, and to automatically perform post-priming head recovery by suctioning ink from the print head after a predetermined post-primary head recovery time period has elapsed.

28. The ink jet printer as set forth in claim 27, wherein the amount of ink suctioned in the post-priming head recovery is less than the amount of ink suctioned to initially prime the print head.

29. The ink jet printer as set forth in claim 27, further comprising an ink priming completion indicating means for providing an indication of whether ink priming has been completed.

30. An ink jet printer comprising:

an ink tank that stores ink;

an ink jet head comprising a nozzle that ejects ink to print a character on a printing medium;

an ink path that supplies ink from the ink tank to the ink jet head;

an ink suction means for suctioning ink from the nozzle;

an ink priming completion indicating means for indicating if priming of the ink jet head is complete and that is set after completion of priming the ink jet head;

a post-priming head recovery timing means for counting time from completion of priming the ink jet head and setting of the ink priming completion indicating means; and a drive control means responsive to the post-priming head recovery timing means for automatically controlling the ink suction means to perform post-priming head recovery by suctioning a predetermined amount of ink from the ink jet head after a predetermined post-priming head recovery time period has been counted by the post-priming head recovery timing means, the post-priming head recovery time period being commensurate with a time period in which a bubble left in the link path during ink priming expands to a predetermined size.

31. The ink jet printer as set forth in claim 30, wherein the amount of ink suctioned in the post-priming head recovery is less than the amount of ink suctioned to initially prime the print head.

32. The ink jet printer as set forth in claim 30, wherein the ink priming completion indicating means comprises an ink priming completion flag.

* * * * *

UNITED STATES PATENT AND TRADEMARK OFFICE

CERTIFICATE OF CORRECTION

PATENT NO. : 6,364,448 B2
DATED : April 2, 2002
INVENTOR(S) : Atsushi Nishioka et al.

It is certified that error appears in the above-identified patent and that said Letters Patent is hereby corrected as shown below:

Column 15,
Line 1, correct “for” to -- from --.

Signed and Sealed this

Twenty-seventh Day of August, 2002

*Attest:*

*Attesting Officer*

JAMES E. ROGAN
*Director of the United States Patent and Trademark Office*